US005672837A

United States Patent [19]

Setoguchi et al.

[11] Patent Number: 5,672,837

[45] Date of Patent: Sep. 30, 1997

[54] AUTOMATIC PERFORMANCE CONTROL APPARATUS AND MUSICAL DATA STORING DEVICE

[75] Inventors: Masaru Setoguchi, Mizuhomachi; Yoshinori Yashiro, Tokyo, both of Japan

[73] Assignee: Casio Computer Co., Ltd., Tokyo, Japan

[21] Appl. No.: 576,481

[22] Filed: Dec. 21, 1995

[30] Foreign Application Priority Data

Dec. 29, 1994 [JP] Japan ..... 6-339364
Dec. 29, 1994 [JP] Japan ..... 6-340418

[51] Int. Cl.[6] ..... G10H 1/26; G10H 1/40

[52] U.S. Cl. ..... 84/609; 84/612

[58] Field of Search ..... 84/609–614, 634–638

[56] References Cited

U.S. PATENT DOCUMENTS 4,355,559 10/1982 Uya et al. .
4,417,494 11/1983 Nakada et al. .
5,254,803 10/1993 Terao .
5,492,049 2/1996 Aoki et al. ..... 84/611
5,495,073 2/1996 Fujishima et al. ..... 84/609

*Primary Examiner*—Stanley J. Witkowski
*Attorney, Agent, or Firm*—Frishauf, Holtz, Goodman, Langer & Chick

[57] ABSTRACT

Measures each contain plural event data, which are memorized in an arrangement of SNG-SONG. 1024 measures (the first measure to 1023-th measure) in each music or in each track of the music are grouped into 8 measure blocks. Leading event data of 8 measure blocks each containing 128 measures are memorized in an arrangement of SNG-BAR-PTR. Element numbers of leading event data of respective 128 measures contained in each measure block are memorized in an arrangement of SNG-BAR-TBL. For example, increment or decrement of a point value of the measure block in the arrangement of SNG-BAR-TBL or the measure in the arrangement of SNG-BAR-PTR allows a fast forward reproduction and/or a fast rewind reproduction.

23 Claims, 13 Drawing Sheets

FIG.5A
TRACK-END EVENT DATA
FIG.5B
MEASURE-END EVENT DATA
FIG.5C
JUMP-TO EVENT DATA
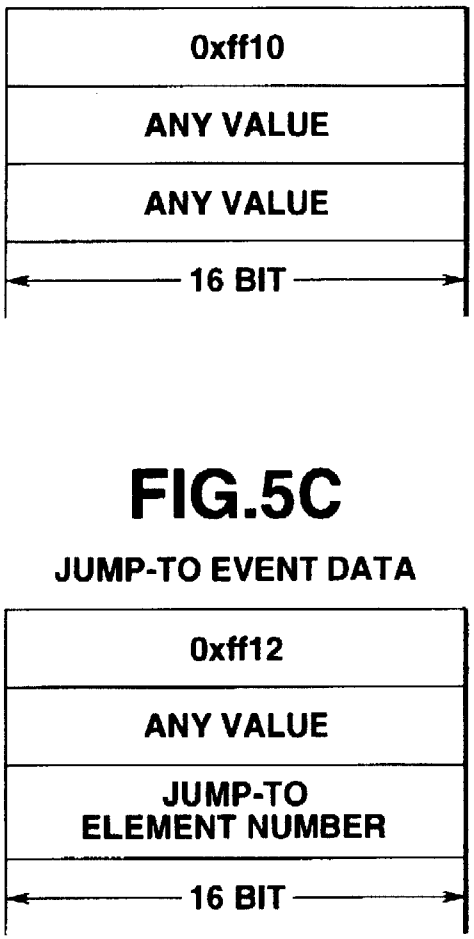
FIG.5D
JUMP-FROM EVENT DATA
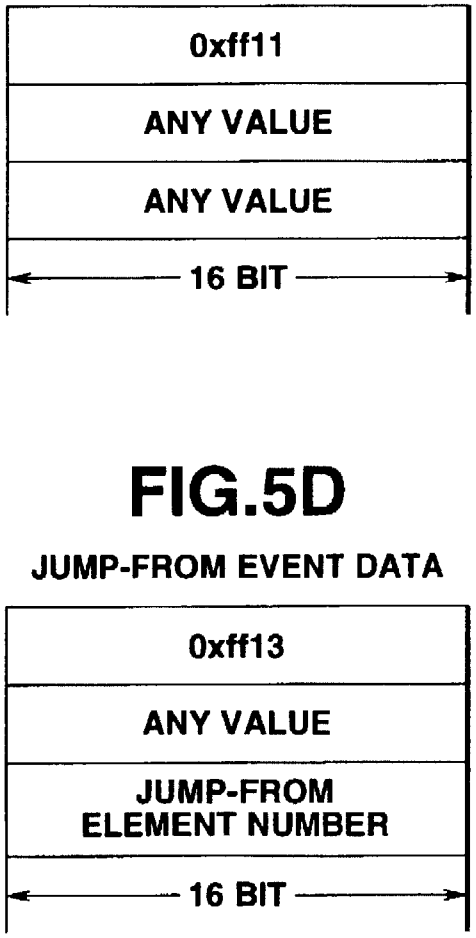

AUTOMATIC PERFORMANCE CONTROL APPARATUS AND MUSICAL DATA STORING DEVICE

BACKGROUND OF THE INVENTION

1. Field of the Invention

The present invention relates to an automatic performance control technique for automatically playing musical data stored in a memory of an automatic performance apparatus.

2. Description of the Related Art

In a conventional automatic performance apparatus for automatically playing a music, musical data are stored in a memory which data are arranged in a data format as follows:

For example, in a standard MIDI file, a delta time between data such as a note-on event and a note-off event has a data format between event data.

Further, a data format is known that has a gate time equivalent to a time between note-on event and note-off event, and a step time equivalent to a time between the note-off event and a following note-on event or note-off event.

No trouble will be caused so long as these data formats are used only to read and reproduce event data. However, when event data are edited, and/or a jump process from one event data to other event data at random are executed, troublesome and complicated controls are required to perform data processes corresponding to the above data processes on these data formats.

SUMMARY OF THE INVENTION

The present invention has an object to provide an automatic performance control apparatus which is capable of in a simple manner performing an editing process on event data such as a jump process to be performed on data in a measure.

According to one aspect of the Invention, there is provided an automatic performance control apparatus which comprises:

first memory for storing plural measure data each containing plural event data, each event data including time data counted from a leading position in the measure data;

second memory for storing plural measure-data designating data which designate locations in said first memory where event data contained in the measure data are stored; and control means for processing measure-data designating data stored in said second memory to control automatic performance of event data contained in the plural measure data stored in said first memory.

In the automatic performance control apparatus having the above mentioned structure, increment or decrement by the control means of measure-data designating data stored in the second memory means allows fast forward or rewind reproduction of musical data contained in measure data. Therefore, a simple control process allows the fast forward and rewind reproduction of one and more measure data.

Replacement of measure-data designating data stored in the second memory allows an editing process of musical data, for example, a rearrangement of measure data. In this case, since each musical data contained in measure data has time data counted from a leading position of the measure, there is no need to amend time data when the measure data is rearranged.

Further, to insert a new musical data to the musical data contained in the measure data, the control means adds musical data to a tail position of the first memory, and sets data corresponding to the new musical data in the second memory.

Further more, musical data can be inserted or deleted vet easily by a simple data process.

In the present automatic performance control apparatus, musical data are controlled in an heiarchical system using the first and second memories and, therefore, control of musical data such as a reproduction and/or edition of musical data can be performed in a very simple way.

The present invention has another object to provide a musical data storing device which allows an editing process and a jump process of measure data.

According another aspect of the present invention, there is provided a musical-data storing device which comprises:

first memory for storing plural measure data each containing plural event data, each event data including time data counted from a leading position in the measure data; and second memory for storing plural measure-data designating data which designate locations in said first memory where event data contained in the measure data are stored.

The musical data storing device is capable of performing a fast rewind and/or forward reproduction of musical data. Simple data processing in the present musical data storing device allows editing processes such as moving measure data to other position, inserting new musical data into measure data, inserting and deleting musical data, and the like. In the present automatic performance control apparatus, musical data are controlled in an heiarchical system using the first and second memories and, therefore, control of musical data such as a reproduction and/or edition of musical data can be performed in a very simple way.

BRIEF DESCRIPTION OF THE DRAWINGS

Other objects and features of the present invention will be understood by those skilled in the art from the detailed description of the preferred embodiment with reference to the accompanying drawings, in which:

FIG. 5(A) is a view showing a data format of track-end event data contained in measure data;

FIG. 5(B) is a view showing a data format of measure-end event data contained in measure data;

FIG. 5(C) is a view showing a data format of jump-to event data contained in measure data;

FIG. 5(D) is a view showing a data format of jump-from event data contained in measure data;

DETAILED DESCRIPTION OF THE PREFERRED EMBODIMENTS

Now, an embodiment of the present invention will be described in detail with reference to the accompanying drawings.

Figure 1:
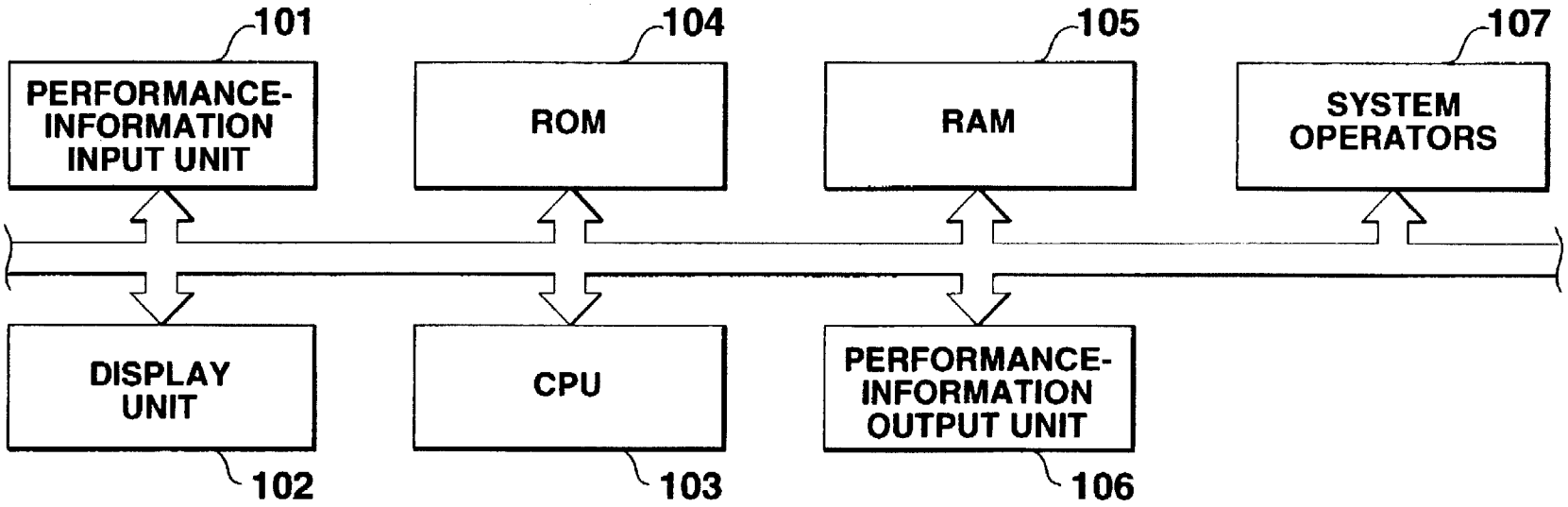
FIG. 1 is a block diagram of an essential part of the embodiment of the present invention.

FIG. 1 is a view showing a whole structure of the embodiment of the present invention. The embodiment of the present invention is used in a sequencer apparatus.

In the sequencer apparatus, a central processing unit (CPU) 103 serves to control operation of a whole system of the sequencer apparatus in accordance with a control program stored in a read only memory (ROM) 104.

In a musical-data recording mode of the sequencer apparatus, performance information output from an electronic musical instrument (not shown) is transferred to a performance-information input unit 101 of the sequencer apparatus in accordance with Musical Instrument Digital Interface Standard (MIDI). The CPU 103 takes in the performance information, and successively records event data representative of the performance information together with input timing data, if necessary, on recording tracks in a musical-data recording area of the RAM 105. A user of the sequencer apparatus previously manipulates system operators 107 to designate the recording tracks in the musical-data recording area of the RAM 105.

In a musical-data editing mode, the CPU 103 reads out musical data recorded on desired tracks in the musical-data recording area of the RAM 105 in accordance with contents previously set by the system operators 107, and displays on a display unit 102 the read out musical data which is expressed in a staff notation. The user is allowed to perform various editing operations, such as "insert", "delete", "move" and "copy", on the musical data displayed on the display unit 102 by the use of the system operators 107. The results of the editing operation affect musical data recorded in the musical-data recording area of the RAM 105.

In a musical-data reproducing mode, event data are successively read out from the recording tracks in the musical-data recording area of the RAM 105, and performance information corresponding to the read out event data are output in accordance with the MIDI standard from a performance-information output unit 106 of the sequencer apparatus to an external electronic musical instrument or to an external sound source. The electronic musical instrument or the sound source performs an automatic performance based on the supplied musical information.

FIGS. 2–5D are views showing data formats of musical data recorded in the RAM 105.

In the present embodiment, musical data representative of a music has a hierarchical structure, that is, musical data comprises 16 track data, each track data includes 8 measure block data at maximum, and each measure block data further includes 128 continuous event data. The event data are prepared in unit of measure.

Figure 2:
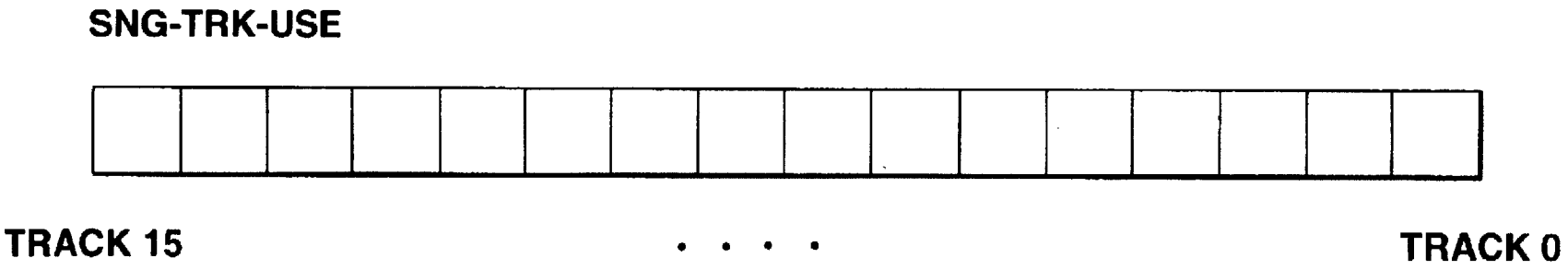
FIG. 2 is a view showing a data format of track data in musical data stored in RAM 105 of FIG. 1.
Figure 3:
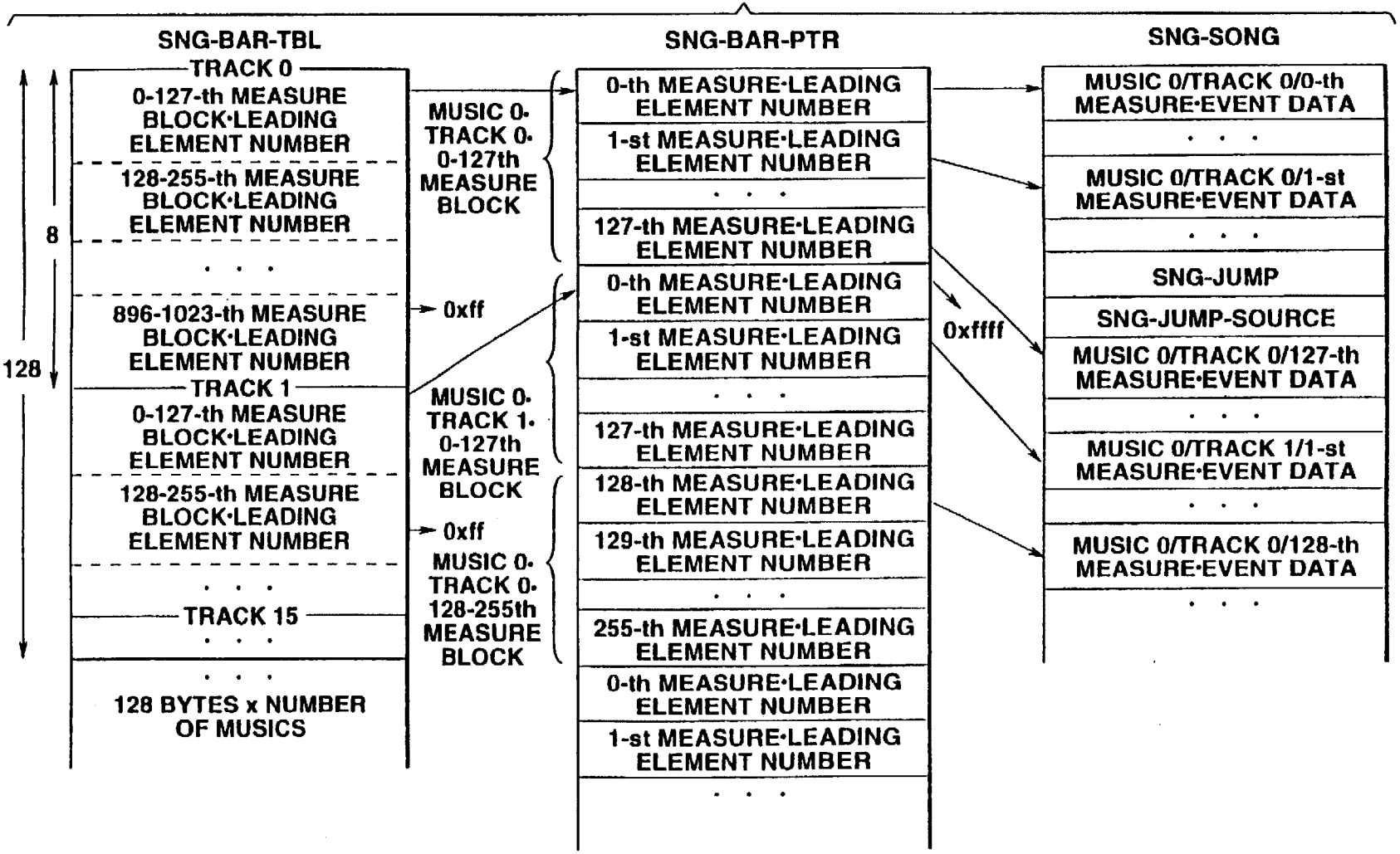
FIG. 3 is a view showing data formats of arrangements of musical data stored in the RAM 105.

Track state data SNG-TRK-USE shown in FIG. 2 is data of 16 bits, and is set for each of musics. Each track state data comprises 16 tracks from Track 0 to Track 15, for each of which tracks a flag "1" or "0" is set to indicate whether or not the pertinent track is used in the automatic performance. The least significant bit of the data corresponds to Track 0 and the most significant bit thereof corresponds to Track 15.

In an arrangement of SNG-BAR-TBL shown at FIG. 3A are recorded leading element informations, which correspond respectively to data groups each including 128 data arranged in an arrangement of SNG-BAR-PTR shown at FIG. 3B. The leading element informations correspond respectively to 8 measure blocks, which are obtained by dividing 1024 measures from 0-th measure to 1023-th measure in each track by 128 for each music. A number of measure blocks which can be defined in the arrangement of SNG-BAR-PTR is 32 at maximum. In this case, any one of values "0x00" to "0x1f", which correspond respectively to 0 to 31 in the decimal system, is recorded in the arrangement of SNG-BAR-TBL as the leading element information of the measure block. A product obtained by multiplying a value of the leading element information of the measure block by 128 will be a leading element number, corresponding to the measure block, of a data group of 128 data arranged in the arrangement of SNG-BAR-PTR. A value of "0xff" is set for the leading element information of measure blocks in not-used tracks and the leading element information of not-used measure blocks in used tracks.

In an arrangement of SNG-BAR-PTR shown at FIG. 3B are recorded leading element numbers of respective groups of event data arranged in an arrangement of SNG-SONG shown at FIG. 3C. The leading element numbers correspond respectively to 128 measures in each measure block. A number of event data which can be defined in the arrangement of SNG-SONG is, for example, 16384 at maximum. In this case, any one of "0x0000" to "0x4000", which correspond respectively to 0 to 16383 in the decimal system, is recorded as a leading element number of event data in each measure in the arrangement of SNG-BAR-PTR. A value of "0xffff" is set for the leading number of measures of a whole rest.

As described above, event data in unit of measure are continuously recorded in the arrangement of SNG-SONG. One event data is prepared as data of three words, as will be described later. The arrangement of SNG-SONG is divided into 32 event data blocks (16384 event data) each including 512 event data. When event data in one measure are divided into two event data blocks (first and second event data block), a jump-to event data, as will be described later, is recorded at the last or tail position of the first event data block and a jump-from event data, as will be described later, is recorded at the leading position in the second event data block.

Figure 4B:
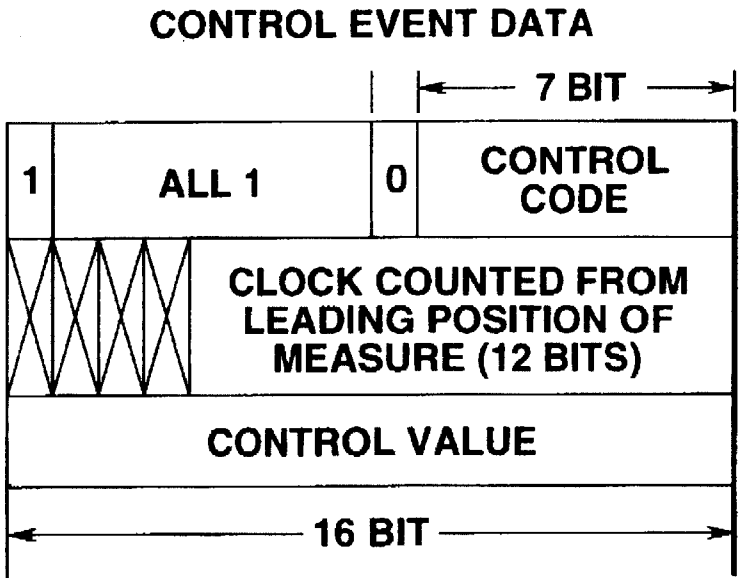
FIG. 4(B) is a view showing a data format of control event data contained in measure data.
Figure 4A:
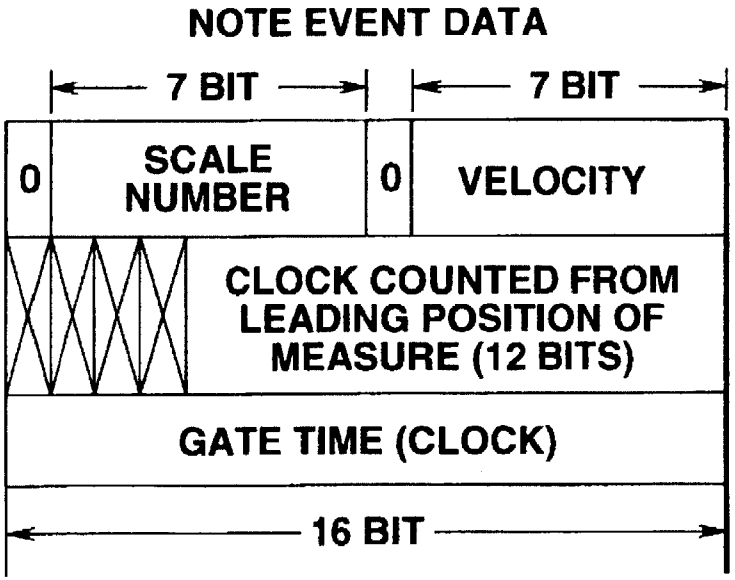
FIG. 4(A) is a view showing a data format of note event data contained in measure data.

FIGS. 4(*a*) and 4(*b*) are views showing a data format of note event data and a data format of control event data. The note event and control event data constitute an event data group recorded in the arrangement of SNG-SONG shown at FIG. 3C, and each event data is prepared as data of three words.

The note event data of FIG. 4(*a*) corresponds to a note to be written on a music sheet, and includes various informations required for a sound generating process of a single sound. More specifically, the first word of the note event data includes seven significant bits representing a number of a sound level (a frequency) and seven less significant bits representing a velocity of the sound. The second word of the note event data represents a time position of a note corresponding to the note event data, which time position is counted in a proper unit (for example, in a unit or clock of 1/480 beat) from the leading position of a measure in which the note is included. The third word of the note event data represents a gate time or a sound time of the note corresponding to the note event data, at which sound time the note is sounded. The gate time or the sound time of the note is counted in the above unit.

The control event data shown in FIG. 4(*b*) is an event data other than the above note event data, which event data is necessary for controlling reproduction of a music. The control event data can be distinguished from the note event data, since the most significant bit of the first word of the control event data is 1. The control event data is classified into three groups: meta event data group; jump event data group; and command event data group. The meta event data group includes information relating to a tempo, a beat, and a key of a music. The jump event data group includes information relating control positions of event data such as a track end, a measure end, and a jump position of data to be processed next, which will be described in detail later with reference to FIGS. 5(*a*) and 5(*b*). Further, the command event data group includes information for adding a figuration effect to a music such as loudness, timbre, and bender. Seven less significant bits of a first word of the control event data represent a control code for specifying contents of control. For example, a value of the first word corresponding to tempo event data in the meta event data group is "0xff00". The first word corresponding to measure-end event data in the jump event data group is given a value of "0xff11" (FIG. 5(*b*)). The first word corresponding to program-change event data in the command event data group is given a value of "0xff20". The second word of the control event data represents a time position at which a control operation corresponding to the control event data is performed. The time position is counted from the leading position of the measure in the above unit. The third word of the control event data stores necessary control values other than the control code. For example, the third word of the tempo event data in the meta event data group stores a tempo number. The third word of the jump-to event data in the jump event data group stores an element number of event data to which operation is to be jumped within the arrangement of SNG-SONG (at FIG. 3C). The third word of the program-change event data in the command event data group stores a tone color number.

Now, four kinds of event data constituting the jump event data group among the control event data will be described. FIGS. 5(*a*)–5(*d*) are views showing formats of the four kinds of event data respectively.

The track-end event data of FIG. 5(*a*) is a final event data inserted into each of the event data groups of respective tracks at the end of the track.

The measure-end event data of FIG. 5(*b*) is a final event data inserted into each of the event data groups of respective measures at the end of the measure.

When an event data group in one measure of the arrangement of SNG-SONG shown at FIG. 3C is divided into two event data blocks (first and second event data blocks) each containing 512 events, the jump-to event data of FIG. 5(*c*) is recorded at the last or tail position of the first event data block and the jump-from event data is recorded at the leading position of the second event data block. The third word of the jump-to event data stores an element number of the event data to which process is to jump within the arrangement of SNG-SONG. The third word of the jump-from event data stores an element number of the event data from which process is to jump within the arrangement of SNG-SONG.

In an event-data editing and reproducing processes for processing the four kinds of event data shown in FIGS. 5(*a*)–5(*d*), processes corresponding to the respective event data are performed instantly at a time when it is recognized based on the first word that event data under processing is data belonging to the jump event data group. Therefore, the second words of respective event data can take any values. The third words of the track-end event data and the measure-end event data can also take any values.

As described above, employment of the musical data formats of FIGS. 2–5(*d*) allows control of an automatic performance to be much efficiently performed. The effect will be described below.

Operation of an event-data reproducing process during the automatic performance will be described. When the user instructs a reproduction of event data by operating the system operators 107 of FIG. 1, the CPU 103 confirms contents of track state data, SNG-TRK-USE, of FIG. 2 corresponding to a music to be reproduced, which music is stored in the RAM 105 of FIG. 1. The CPU 103, at first, searches through the arrangement of SNG-BAR-TBL shown at FIG. 3A to reproduce event data of a track corresponding to a bit of the track state data SNG-TRK-USE at which bit a value "1" has been set, at a timing of processing said track. As a result, the CPU 103 obtains an element number in the arrangement of SNG-BAR-PTR shown at FIG. 3B, which element number corresponds to a measure under reproduction. When the relevant data in the arrangement of SNG-BAR-PTR has not been set to a value of 0xffff (when it is not a music of a whole rest), the CPU 103 reads in event data of the arrangement of SNG-SONG, which event data corresponds to an element number designated by the value of the data in the arrangement of SNG-BAR-PTR. When a clock value counted from the leading position of the measure, which value is stored in the second word, is not larger than a present clock value, the CPU 103 instructs the performance-data output unit 106 of FIG. 1 to output performance data in accordance with data of the first word of the event data to reproduce the event data. Thereafter, the above processes are repeatedly performed, whereby event data are reproduced in accordance with the present clock of the present measure.

A fast forward reproduction or a rewind reproduction during the event-data reproducing process will be described. To perform the fast forward or a rewind reproduction, a pointer value of the present process with respect to the measure block in the arrangement of SNG-BAR-TBL shown at FIG. 3A or a pointer value of the present process with respect to the measure in the arrangement of SNG-BAR-PTR shown at FIG. 3B is simply incremented or decremented. Then, the fast forward reproduction or rewind reproduction can be performed under simple control at an extremely high speed or at a transferring rate in unit of several measures.

Now, an event-data editing process will be described. Replacement of data arranged in the arrangement of SNG-BAR-TBL of FIGS. 3A–3C or in the arrangement of SNG-BAR-PTR will allow to move, for example, in unit of measure. In this case, since clock data memorized in the arrangement of SNG-SONG shown at FIG. 3C represents a clock value counted from the leading position of a measure (FIG. 4(*a*)), there is no need to re-edit time data. Further, for example, when a new event data is added to a memorized measure, event data group is added to the end position of the arrangement of SNG-SONG shown at FIG. 3C, and the added event data group is connected to event data group in a desired measure by means of the jump-to event data and the jump-from event data (FIGS. 5(*c*) and 5(d)). Similarly, insertion and/or deletion of event data can be executed by a simple data process.

As described above, the hierarchical structure of musical data allows event data to be simply subjected to a control process such as the reproduction and the editing processes. When the editing process such as insertion, deletion and moving of event data is performed within a measure in the event-data editing process of event data of musical data having the hierarchical structure, a clock value counted from the leading position of the measure, which is set in the second word of event data other than jump event data group of FIG. 5(*c*), can be disordered within event data group in one of measures in the arrangement of SNG-SONG of FIGS. 3A–3C. For example, when it is desired to insert a new event data at a certain time position in a measure, jump-from event data, the desired event data whose second word is set to a desired clock value, and measure-end event data are added to the end of the arrangement of SNG-SONG, and the measure-end event data of the desired measure is replaced with jump event data whose third word is set to the element number of the above jump-from event data, and, finally, the element number of the above jump-to event data is set to the third word of the above jump-from event data. In this case, since the above inserted event data is simply added to the tail or end position of the event data group in the desired measure, the event data group of the desired measure including the inserted event data must be disposed (or sorted) with respect to the clock values of the second words of the respective event data. It is important that the jump event data group of FIG. 5(*c*) included in the event data group in the measure is processed properly.

In the present embodiment, event data in the measure are sorted with respect to time in a manner describe below. A sorting process for sorting event data in the measure with respect to time will be described in detail hereafter.

Figure 6:
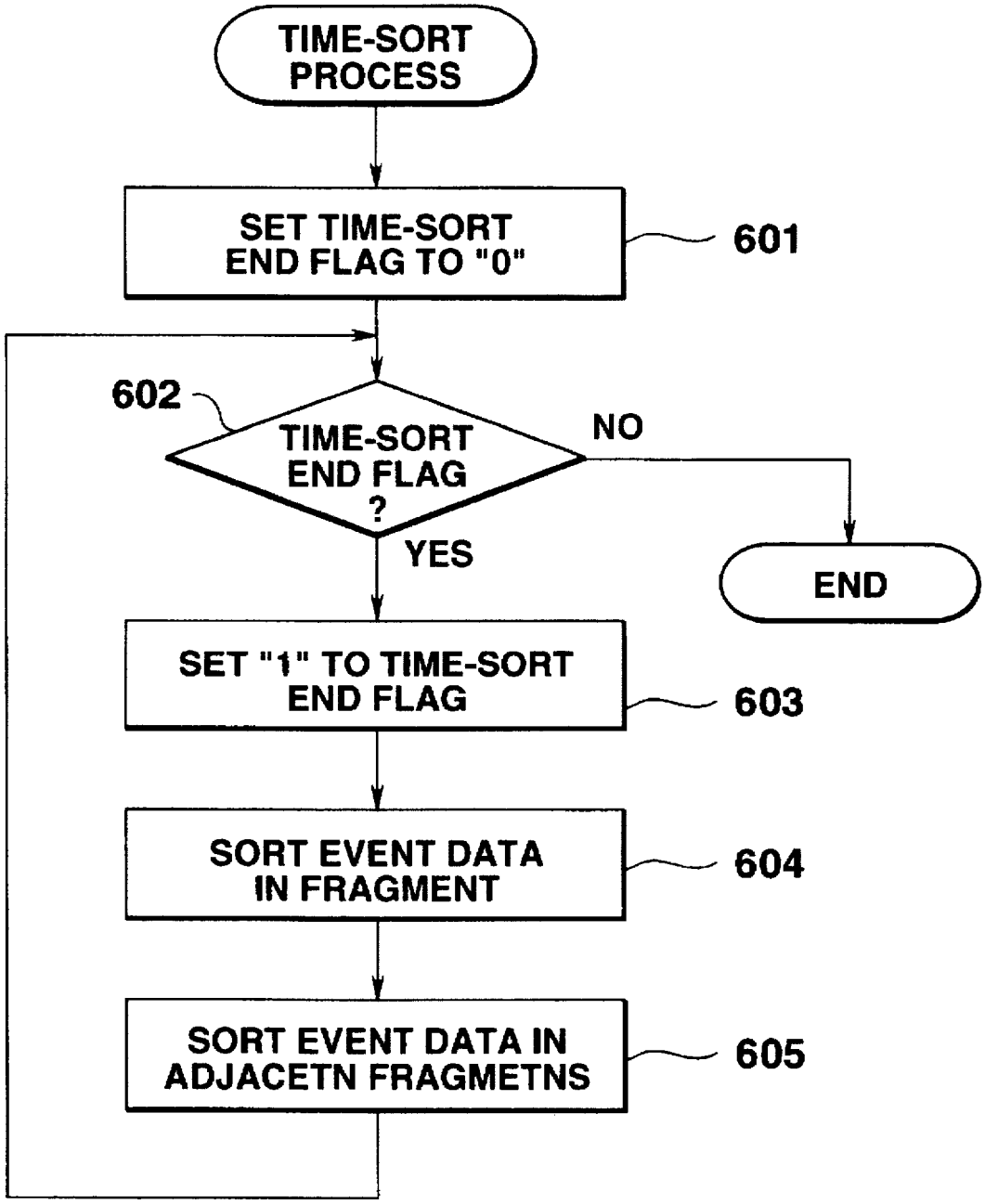
FIG. 6 is a general flowchart of a time-sort process.

FIG. 6 is a flow chart of the time-sort process, which is performed by the CPU 103 in accordance with the control program stored in the ROM 104.

A time-sort end flag (provided in a register in the CPU 103 or in the RAM 105) indicates with its value "0" that the time-sort process is not yet finished, and with its value "1" that the time-sort process has been finished.

At step 601 of the flow chart of FIG. 6, the time-sort end flag is set to a value "0". A series of processes at steps 603, 604 and 605 are successively and repeatedly executed until it is determined at step 602 that the time-sort end flag is set to a value "0".

At step 603, the time-sort end flag is set to a value "1". At step 604, all the event data (hereafter, event-data fragment or fragment), which are included in event data group in the measure to be sorted and fall within the range defined by the jump-to event data and the jump-from event data, are subjected to the sort process with respect to time (fragment sort process).

At step 605, event data located at connecting positions among adjacent event-data fragment in the above measure stored in the arrangement of SNG-SONG are sorted with respect to time (fragment sort process).

The above fragment sort process of step 604 and the fragment sort process of step 605 are repeatedly executed, and, when no event data to be replaced is left during both the fragment sort process, the time-sort process for sorting event data in the measure memorized in the arrangement of SNG-SNG is finished. More specifically, when event data is found to be replaced at step 604 or 605, the time-sort end flag is set to a value "0". Therefore, the result of the judgement at step 602 is YES, and the time-sort process is further executed. Meanwhile, when no event data is found to be replaced at step 604 or 605, a process to set the value "0" to the time-sort end flag is not executed at step 604 or 605. Therefore, since the time-sort end flag keeps the value "1", the result of the judgement at step 602 will be NO, and the time-sort process is finished.

Figure 7:
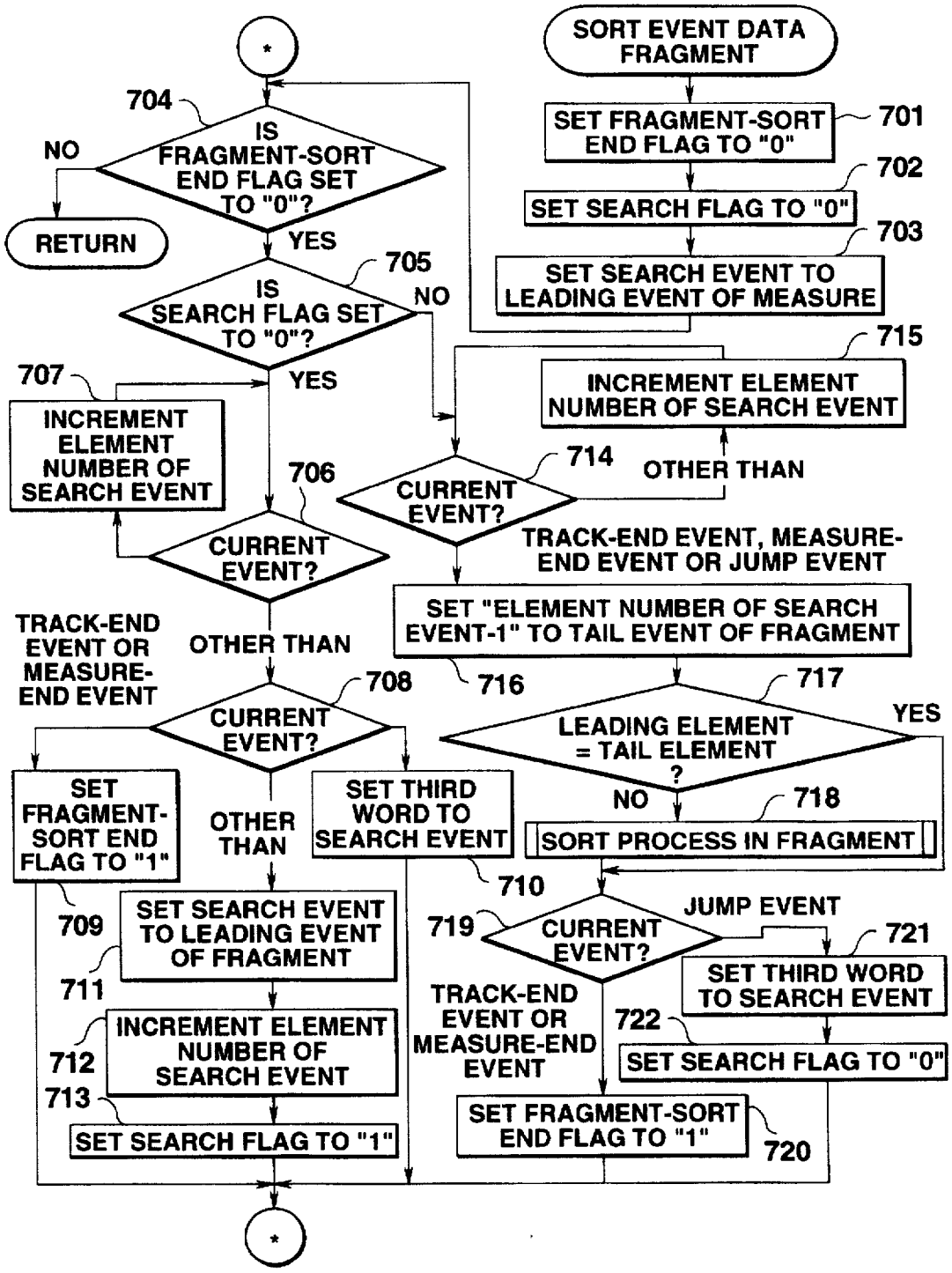
FIG. 7 is a flowchart of a sort process of event data within an event data fragment.

FIG. 7 is a detailed flow chart of the fragment-sort process of step 604. A fragment-sort end flag (provided in the register of the CPU 103 or in the RAM 105) raises a value "0" when the fragment sort process should not be finished, and raises a value "1" when the fragment sort process should be finished. The fragment-sort end flag is initialized to a value "0" at step 701.

A search flag (provided in the register of the CPU 103 or in the RAM 105) takes a value "0", when a search process has not yet been finished for searching through event data fragment under processing, which are included in a measure memorized in the arrangement of SNG-SONG, to find out a leading event data other than the jump-from event data. In the meantime, the search flag takes a value "1", when the search process has been finished. The search flag is initialized to a value "0" at step 702.

A search event (provided in the register of the CPU 103 or in the RAM 105) designates event data under processing among the event data fragment included in the measure memorized in the arrangement of SNG-SONG. The search event is set, at step 703, to an element number of the leading event data in the measure memorized in the arrangement of SNG-SONG. The element number can be easily found by searching through the arrangements of SNG-BAR-TBL and SNG-BAR-PTR.

In the initial state, event data following to the jump-from event data in the event data fragment which is under processing and is included in the measure recorded in the arrangement of SNG-SONG is searched for, when it is determined YES at steps 704 and 705.

Event data (hereafter in the flow chart, current event) designated by the search event is read out from the arrangement of SNG-SONG in the RAM 105.

When it is determined at step 706 that the current event data is the jump-from event data, an element number of the arrangement SNG-SONG designated by the search event is incremented at step 707. Processes at steps 706 and 707 are repeatedly executed, thereby a jump-from event data at the leading position of the event data fragment under processing is ignored.

When the current event data is event data other than the jump-from event data, it is judged at step 708 the sort of the event data.

When it is determined at step 708 that the current event data is track-end event data or measure-end event data (FIGS. 5(*a*) and 5(*b*)), the fragment-sort end flag is set to a value "1" at step 709. More specifically, this means that, since there is no event data to be subjected to the sort process in the event data fragment under processing, and there is no event data group of the measure following to the event data fragment under processing, the operation returns form step 709 to step 704, where the result of the judgment will be NO, wherein the sort process is finished in the event data fragment.

When it is determined at step 708 that the current event data is jump-to event data (FIG. 5(*c*)), an element number stored in the third word of the jump-to event data is set, at step 710, to search event to which process is to jump. More specifically, this means that, there is no event data to be subjected to the sort process in the event data fragment under processing, and there is event data group of the measure following to the event data fragment under processing. Therefore, an element number of a leading event data of a new event data fragment is set to the search event at step 710. Then, when it is determined YES at steps 704 and 705, a leading event data other than the jump-from event data is searched for through a new event data fragment contained in a measure to be processed in the arrangement of SNG-SONG at steps 706–713, again.

Further, when it is determined at step 708 that the current event data is event data other than track-end event data, measure-end event data and jump-to event data, the value of the each event data is set to the leading event data of the event data fragment. The value is the element number of the leading event data other than the jump-from event data which has been found fast in the event data fragment under processing. Thereafter, the element number of the arrangement of SNG-SONG designated by the search event is incremented at step 712, and , then, the search flag is set to a value "1" at step 713 to finish the search process.

As a result, it is determined YES at step 704 and, further, it is determined NO at step 705. The operation goes to steps 714–716, where tail event data other than track-end event data, measure-end event data and jump event data is searched for through the event data fragment under processing in the measure of the arrangement SNG-SONG.

The current event data designated by the search event is read out from the arrangement of SNG-SONG in the RAM 105.

When the current event data is event data other than track-end event data, measure-end event data and jump event data, the operation goes to step 715, where the element number of the arrangement of SNG-SONG designated by the search event is incremented. Processes at steps 714 and 707 are repeatedly executed, thereby event data are successively searched through the event data fragment until the event data becomes any one of track-end event data, measure-end event data and jump event data.

When the current event data is any one of track-end event data, measure-end event data and jump event data, a value obtained by subtracting "1" from the element number designated by the search event is set as a value of a fragment-end event. This value is the tail event data other than the track-end event data, the measure-end event data and the jump event data in the event data fragment under processing.

In the above processes, the leading event data and the tail event data to be subjected to the sort process in the event data fragment under processing are calculated as fragment leading-event data and fragment end-event.

At step 717, it is judged whether element numbers designated by the fragment leading-event data and the fragment tail-event coincide with each other.

When YES at step 717, one event data is left to be subjected to the sort process in the event data fragment under processing, and, therefore, the sort process is not executed at step 718 and processes at step 719 and thereafter will be executed as described later.

When NO at step 717, plural event data are sorted with respect to a clock value of the second word of each event data, which plural event data fall within the range designated by the fragment leading event and the fragment end event in the event data fragment under processing contained in the measure stored in the arrangement of SNG-SONG. This event sort process will be described later with reference to the flow chart of FIG. 13. When event data is actually replaced at step 718, as will be described later, the time-sort end flag is set to a value "0" at step 718. Therefore, in this case, it is determined YES at step 602 of FIG. 6 and the time-sort process is further continued.

When YES at step 717 or after the process is executed at step 717, it is judged at step 719 what is the sort of the current data judged at step 714.

When it is determined at step 719 that the current event data is track-end event data or measure-end event data, the fragment-sort end flag is set to a value "1" at step 720. In this case, since there is no event data of the measure following to the event data fragment under processing, it is determined YES at step 704 after the process of step 720 is executed. Then, the fragment sort process is finished.

When it is determined at step 717 that the current event data is jump event data, the element number stored in the third word of the jump event data is set to search event and search flag is set to a value "0", at step 721. In this case, plural event data are left in the measure following to the event data fragment under processing. Therefore, an element number of a leading event data of a new event data fragment is set to the search event at step 721. Then, when it is determined YES at steps 704 and 705, new event data fragment contained in the measure to be processed in the arrangement of SNG-SONG is subjected to the fragment sort process at step 706 and thereafter.

As described above, in the flow chart of FIG. 7, the respective event data fragments contained in the measure stored in the arrangement of SNG-SONG are subjected once to the fragment sort process at step 604 of FIG. 6.

FIGS. 8–12 are flow charts of the fragment sort process to be executed at step 605.

When the fragment sort process should not be finished, the fragment-sort end flag (provided in the register of the CPU 103 or in the RAM 105) is set to a value "0" while the fragment sort process should be finished, the flag is set to a value "1". The fragment-sort end flag is initialized to a value "0" at step 801.

The search event (provided in the register of the CPU 103 or in the RAM 105) designates event data under processing. The value of the search event is set, at step 802, to an element number of the leading event data in the measure which is to be processed and is stored in the arrangement of SNG-SONG.

An element number of the final event in a first event data fragment (provided in the register of the CPU 103 or in the RAM 105) designates an element number of end or tail event data other than track-end event data, measure-end event data, jump-from event data and jump-to event data in the first event data fragment among two event data fragments under processing, which event data fragments are subjected to the fragment sort process. The value or the element number is set to a value of "0xffff", which can not be used as an element number of the arrangement of SNG-SONG.

In the initial state, when YES at step 804, a flag F1 (provided in the register of the CPU 103 or in the RAM 105) is set to a value "1" at step 805. The flag F1 takes a value "0", when the search process has not been finished for searching through the first event data fragment among two event data fragments under processing in the measure stored in the arrangement of SNG-SONG to find out end or tail event data other than track-end event data, measure-end event data, jump-from event data and jump-to event data. Meanwhile, the flag F1 takes a value "1", when such search process has been finished.

Figure 9:
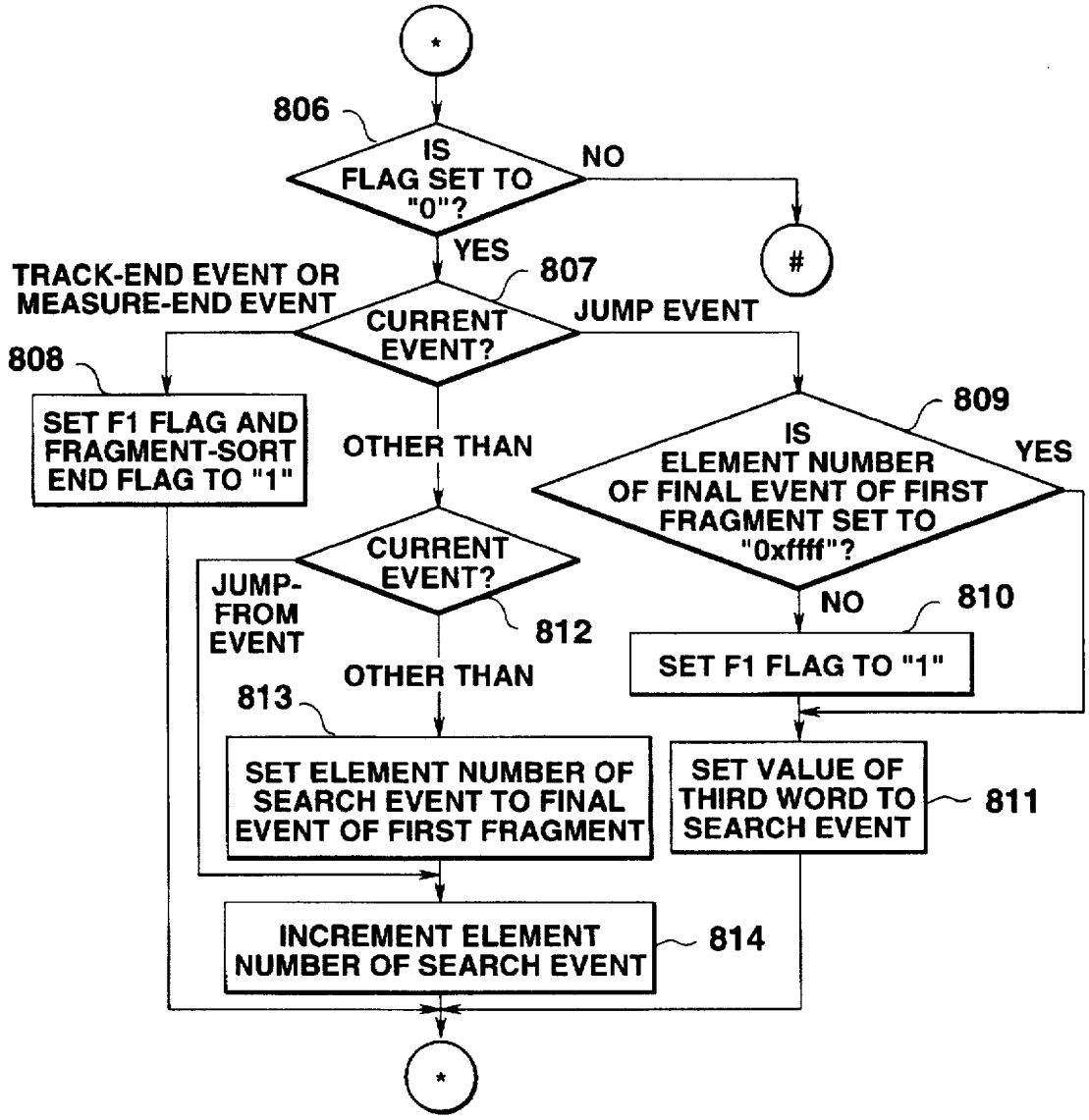
FIG. 9 is a flowchart of a sort process (#2) of event data in two event data fragments.

Further, when YES at step 806 of FIG. 9, the search process is executed at steps 807 to 814 of FIG. 9 to search through the first event data fragment among two event data fragments under processing in the measure stored in the arrangement of SNG-SONG to find out end or tail event data other than track-end event data, measure-end event data, jump-from event data and jump-to event data.

At step 807, the current event data designated by the search event is read out from the arrangement of SNG-SONG in the RAM 105, and the sort of the current event data is judged.

When it is determined at step 807 that the current event data is the track-end event data or the measure-end event data, the operation goes to step 808, where both the flag F1 and the fragment-sort end flag are set to a value "1". More specifically, since there is no final event data to be subjected to the sort process in the first fragment event data under processing and, further, there is left no event data of the measure following to the first event data fragment, the operation goes from step 808 to step 806. where it determined NO (the flag is not "0"). Then, the operation goes via step 815 of FIG. 10 to step 816, where a second-fragment leading-event search process is performed in accordance with the flow chart of FIG. 11. At step 1101 of FIG. 11, it is determined NO and further determined NO at step 817 of FIG. 10. Then, the operation returns to step 804 of FIG. 8, where it is determined NO, and, finally, the fragment sort process is finished.

When it is determined at step 807 of FIG. 9 that the current event data is the jump event data, it is judged at step 809 whether the element number of the final event of the first event data fragment still keeps the initially set value "0xffff".

When there is no event data other than the track-end event data, the measure-end event data, the jump-from event data and the jump-to event data in the first event data fragment among the two event data fragments under processing in the arrangement of SNG-SONG, the element number of the final event data in the first event data fragment keeps the value "0xffff", and it is determined YES at step 809. Then, the operation goes to step 811, where an element number of a new event data fragment stored in the third word of the jump-to event data is set to the search event at step 811. Thereafter, it is determined YES at step 806, again, and the new event data fragment contained in the measure of the arrangement, which is taken as the first event data fragment among the two event data fragments under processing, is subjected to the process at steps 807 to 814.

Further, when it is determined at step 807 that the current event data is event data other than the track-end event data, the measure-end event data, and the jump event data, and, further, when it is determined at step 812 that the current event data is the jump-from event data, then the element number of the arrangement of SNG-SONG designated by the search event is incremented at step 812, and the operation returns to steps 806, 807.

When it is determined at step 807 that the current event data is event data other than the track-end event data, the measure-end event data, and the jump event data, and, further, when it is determined at step 812 that the current event data is event data other than the jump-from event data, the value of the search event is set to the final event data of the first event data fragment at step 813, i.e. the value of the search event is set as an element number of the final event data of the first event data fragment. At step 814, the element number of the arrangement of SNG-SONG designated by the search event is incremented, and the operation returns to steps 706, 708, again.

As described above, the element number of the final event data of the first event data fragment is incremented, and the element number which has been set to the final event data of the first event data fragment, when the jump-to event data is found at step 807, will be the element number of the end event data other than the track-end event data, measure-end event data, jump-from event data and the jump-to event data, which end event data has been found in the first event data fragment among the two event data fragments under processing stored in the arrangement of SNG-SONG. Thereafter, it is determined NO at step 809, and a value "1" is set to the flag F1 at step 810, thereby the search process is finished. An element number of a new event data fragment stored in the third word of the jump-to event data is set to the search event. The element number indicates that the process should be jumped to the new event data fragment.

As a result, the operation returns from step 811 to step 806, where it is determined NO. Then, the operation advances to step 815 of FIG. 10, where a flag F2 (provided in the register of the CPU 103 or in the RAM 105) is set to a value "0". The flag F2 takes a value "0", when the search process has not been finished for searching through the second event data fragment among two event data fragments under processing in the measure stored in the arrangement of SNG-SONG to find out leading event data other than track-end event data, measure-end event data, jump-from event data and jump-to event data. Meanwhile, the flag F2 takes a value "1", when such search process has been finished.

Figure 10:
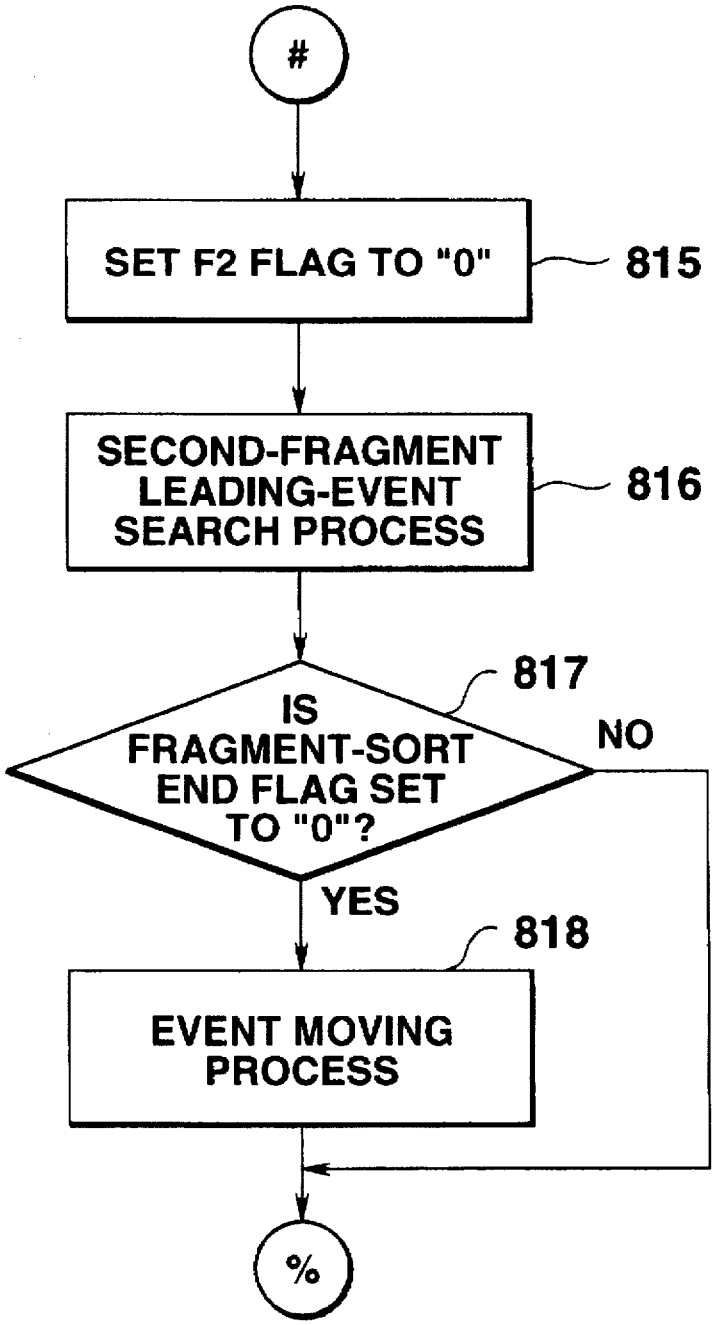
FIG. 10 is a flowchart of a sort process (#3) of event data in two event data fragments.

At step 816 of FIG. 10, a search process is executed for searching through the second event data fragment among the two event data fragments under processing in the measure stored in the arrangement of SNG-SONG to find out leading event data other than the track-end event data, the measure-end event data, the jump-from event data and the jump-to event data.

Figure 11:
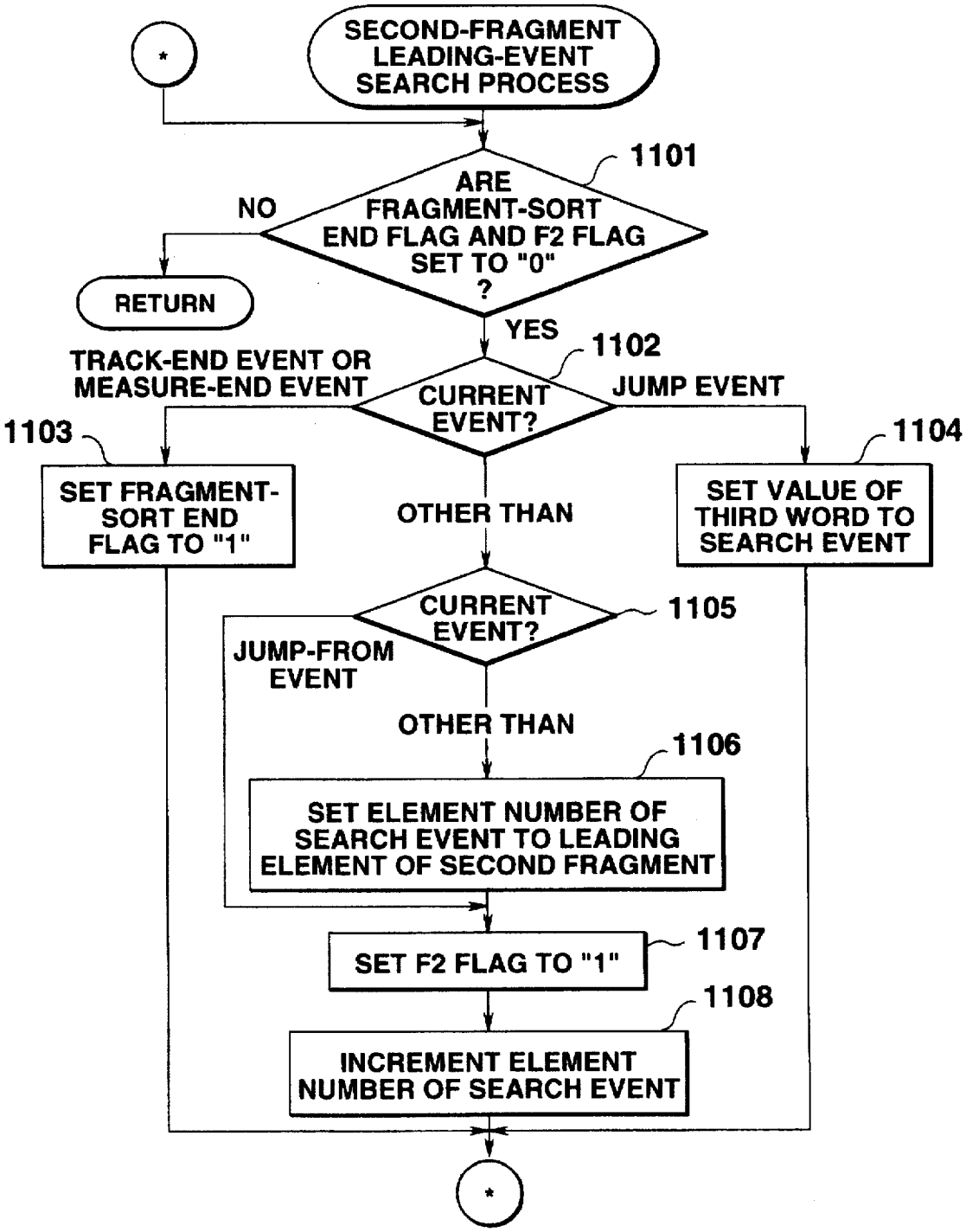
FIG. 11 is a flowchart of a search process for searching for leading event data in the event data fragment.

FIG. 11 is a detailed flow chart of the process executed at step 816 of FIG. 10.

When it is determined at step 815 or at step 1101 of FIG. 11 that the flag F2 has been set to a value "0", i.e., when YES at step 815 or at step 1101, then the operation advances to step 1102 of FIG. 11, where the current event data designated by the search event is read out from the arrangement of SNG-SONG in the RAM 105, and the sort of the event data is judged.

When it is determined at step 1102 that the current event data is track-end event data or measure-end event data, the operation goes to step 1103, where the fragment-sort end flag is set to a value "1". In this case, there is no leading event data to be sorted in the second event data fragment among two event data fragments under processing and there is no event data in the measure following to the second event data fragment. Therefore, it is determined NO at step 1101 after the process has been executed at step 1103, and the process at step 816 of FIG. 10 (the operation of the flow chart of FIG. 11) is finished.

When it is determined at step 1102 that the current event data is jump-to event data, the element number, which process is to jump to and is stored in the third word of the jump-to event data, is set to search event. In this case, there is no event data to be sorted in the second event data fragment among two event data fragments under processing and there is left event data in the measure following to the second event data fragment. Therefore, the element number of the leading event data in a new event data fragment is set to the search event at step 1104. Thereafter, when it is determined YES at step 1101 again, a new event data fragment in the measure stored in the arrangement of SNG-SONG is further processed as the second event data fragment among two event data fragments under processing.

Further, when it is determined at step 1102 that the current event data is event data other than the track-end event data, the measure-end event data, and the jump event data, and, further, when it is determined at step 1105 that the current event data is the jump-from event data, then the element number of the arrangement of SNG-SONG designated by the search event is incremented at step 1108, and the operation returns from step 1101 to step 1102.

When it is determined at step 1102 that the current event data is event data other than the track-end event data, the measure-end event data, and the jump event data, and, further, when it is determined at step 1105 that the current event data is event data other than the jump-from event data, the element number of the search event is set to the leading event data of the second event data fragment at step 1106. The value is the element number of the leading event data other than the track-end event data, the measure-end event data, the jump-from event data and the jump-to event data, which leading event data is found first in the second event data fragment among two event data fragments under processing contained in the measure. TO finish the search process in the second event data fragment, the flag F2 is set to a value "1" at step 1107 and, then, the element number of the arrangement of SNG-SONG designated by the search event is incremented at step 1108. It is determined NO at step 1101 after the processes are executed at steps 1106–1108, and the search process (shown in FIG. 11) of step 816 of FIG. 10 is finished.

As described above, when the tail event data has been successively found in the first event data fragment among two event data fragments contained in the measure in the arrangement of SNG-SONG at steps 807–814 of FIG. 9, and, further, when the leading event data has been found in the second event data fragment at step 816 of FIG. 10, it is determined YES at step 817. Then, the operation goes to step 818, where an event moving process will be performed with respect to the tail event data of the first event data fragment and the leading event data of the second event data fragment.

Figure 12:
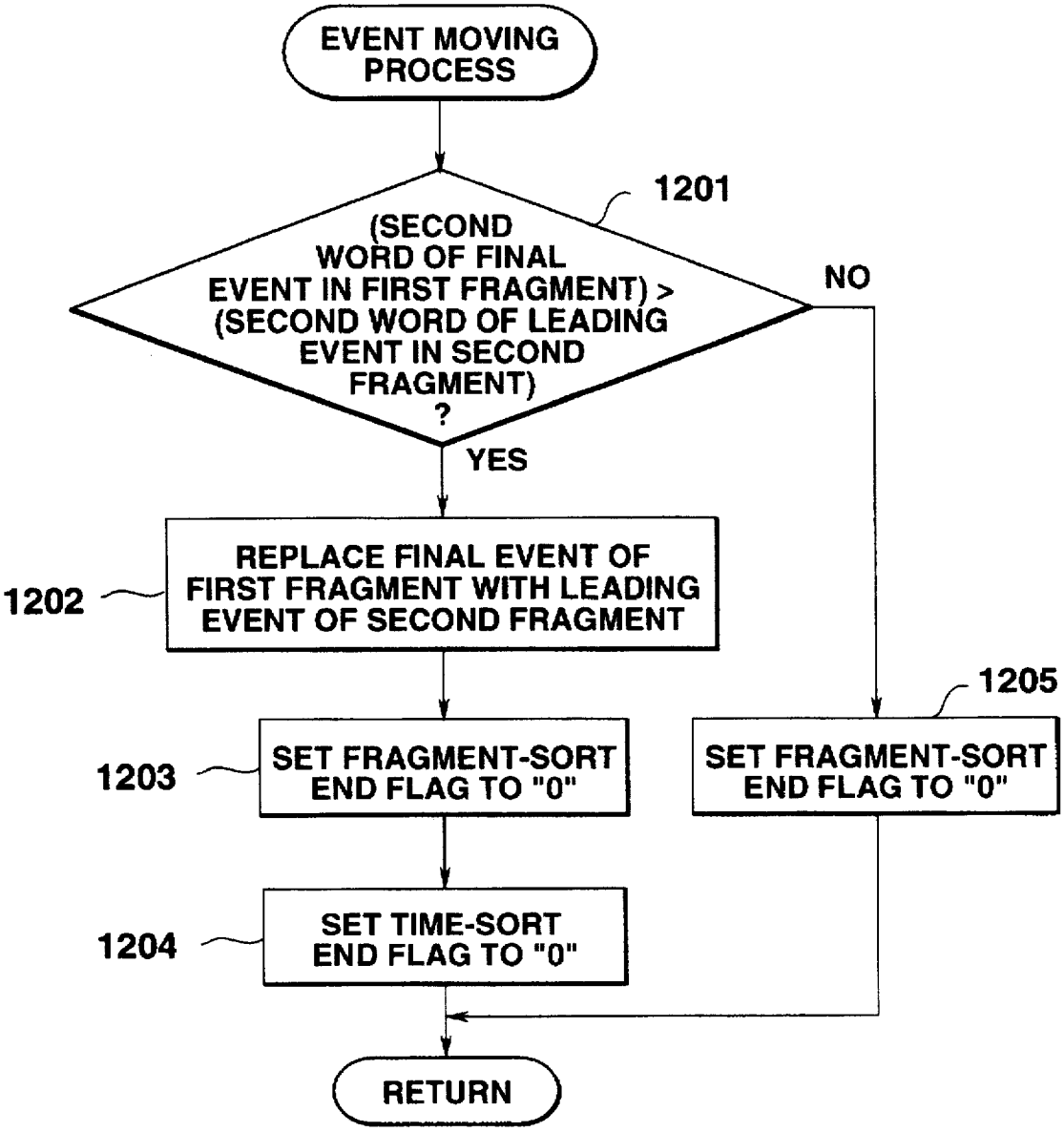
FIG. 12 is a flowchart of an event moving process.

FIG. 12 is a flow chart of the event moving process to be executed at step 818 of FIG. 10.

Event data of an element number designated by the element number of the tail event data of the first event data fragment and event data of an element number designated by the element number of the leading event data of the second event data fragment are read out from the arrangement of SNG-SONG in the RAM 105. It is judged at step 1201 whether a value of the second word of the event data corresponding to the tail-event element number of the first event data fragment is larger than a value of the second word of the event data corresponding to the leading-event element number of the second event data fragment. In other words, it is judged whether the event data corresponding to the tail-event element number of the first event data fragment should be arranged so as to follow the event data corresponding to the leading-event element number of the second event data fragment.

When YES at step 1201, the event data corresponding to the tail-event element number of the first event data fragment is replaced with the event data corresponding to the leading-event element number of the second event data fragment and vice versa, at step 1201. Thereafter, the fragment-sort end flag and the time-sort end flag are set to a value "0" at steps 1203 and 1203, respectively. As described above, when event data have been actually replaced with each other, the operation goes to steps 604 and 605, since the time-sort end flag is set to "0". A sort process is performed within the fragment at step 604, and a sort process is performed between the fragments at step 605, and, thereafter, the operation returns to step 602, where it is determined that the time-sort end flag is set to a value "0" (it is determined YES). Then, the time sort process is further executed.

When NO at step 602, the event data corresponding to the tail-event element number of the first event data fragment is not replaced with the event data corresponding to the leading-event element number of the second event data fragment, and the fragment-sort end flag is set to a value "0".

As described above, the sort process is performed within two event data fragments under processing contained in the measure stored in the arrangement of SNG-SONG.

Figure 8:
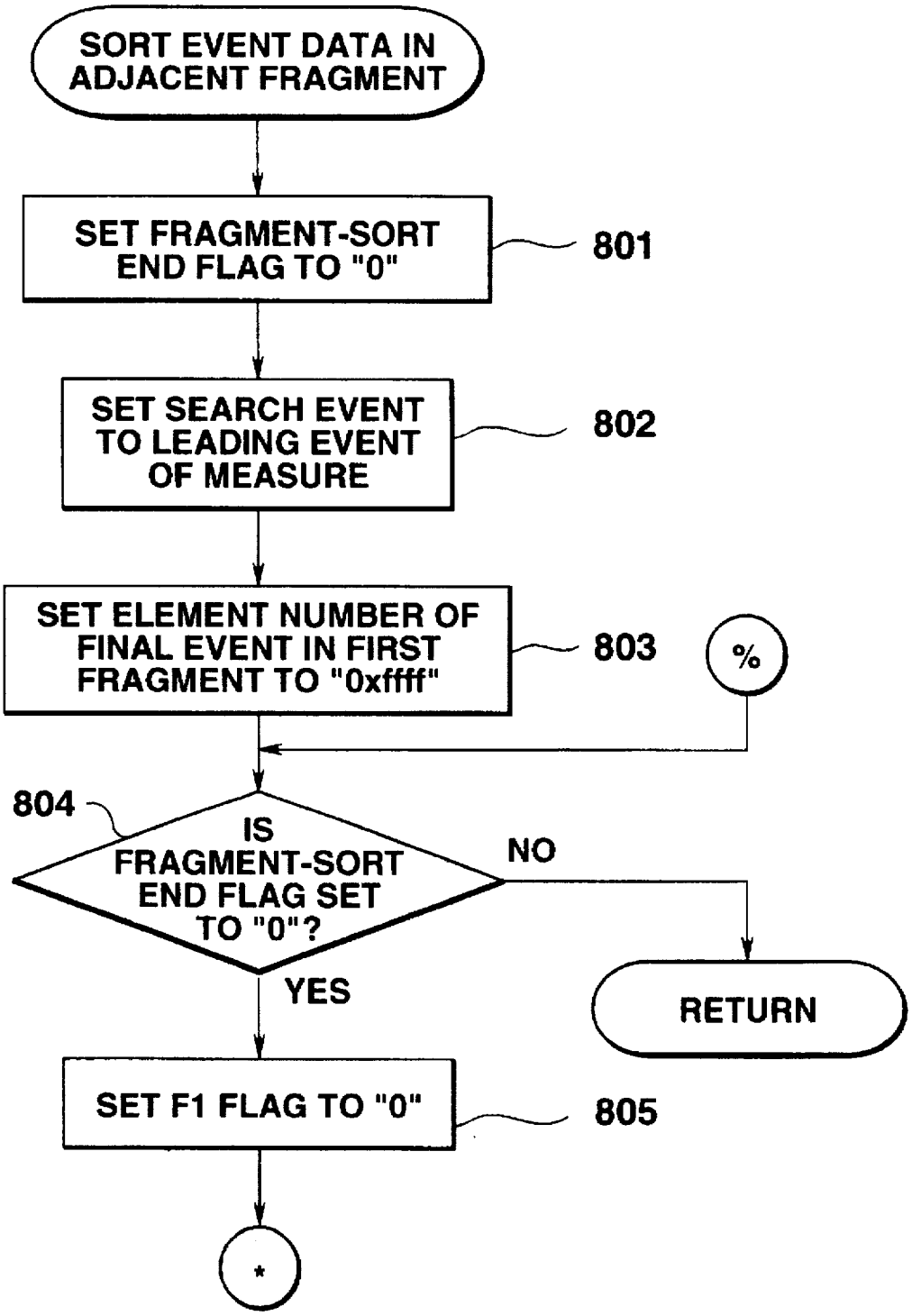
FIG. 8 is a flowchart of a sort process (#1) of event data in two event data fragments.

After processes of steps 1204 and 1205 are executed, the operation goes to step 804 of FIG. 8, where it is determined that the fragment-sort end flag is set to a value "0" (it determined YES). At step 805 and thereafter, tail event data of the first event data fragment and leading event data of the second event data fragment are searched for through the measure stored in the arrangement of SNG-SONG. The two searched event data are subjected to the event moving process. In this case, since the value of the search event designates the leading event data of the second event data fragment, the (original) second event data fragment is processed as a new first event data fragment, and event data fragment in a measure following to the (original) second event data fragment (the new first event data fragment) is processed as a new second event data fragment.

The above processes are repeatedly executed, and, therefore, track-end event data or measure-end event data are found at step 807 while the second event data fragment in the measure is processed as a first event data fragment. Then, the flag F1 and the fragment-sort end flag are set to a value "1" at step 808. More specifically, in this case, there is left no final event data to be sorted in the first event data fragment under processing and there is no event data in the measure following to the first event data fragment, and, the operation returns from step 808 to step 806, where it is determined NO. Then, the operation goes to step 815 of FIG. 10, where the flag F2 is set to "1". The operation advances to step 816, where a sorting process is executed on event data in event data fragments adjacent to each other in accordance with the flow chart of FIG. 10. At step 1101 of FIG. 11, it is determined NO, and, further, it is determined NO at step 817 of FIG. 10. Further, it is determined NO at step 804 of FIG. 8, wherein the sorting process for event data in the event data fragments adjacent to each other is finished.

Figure 13:
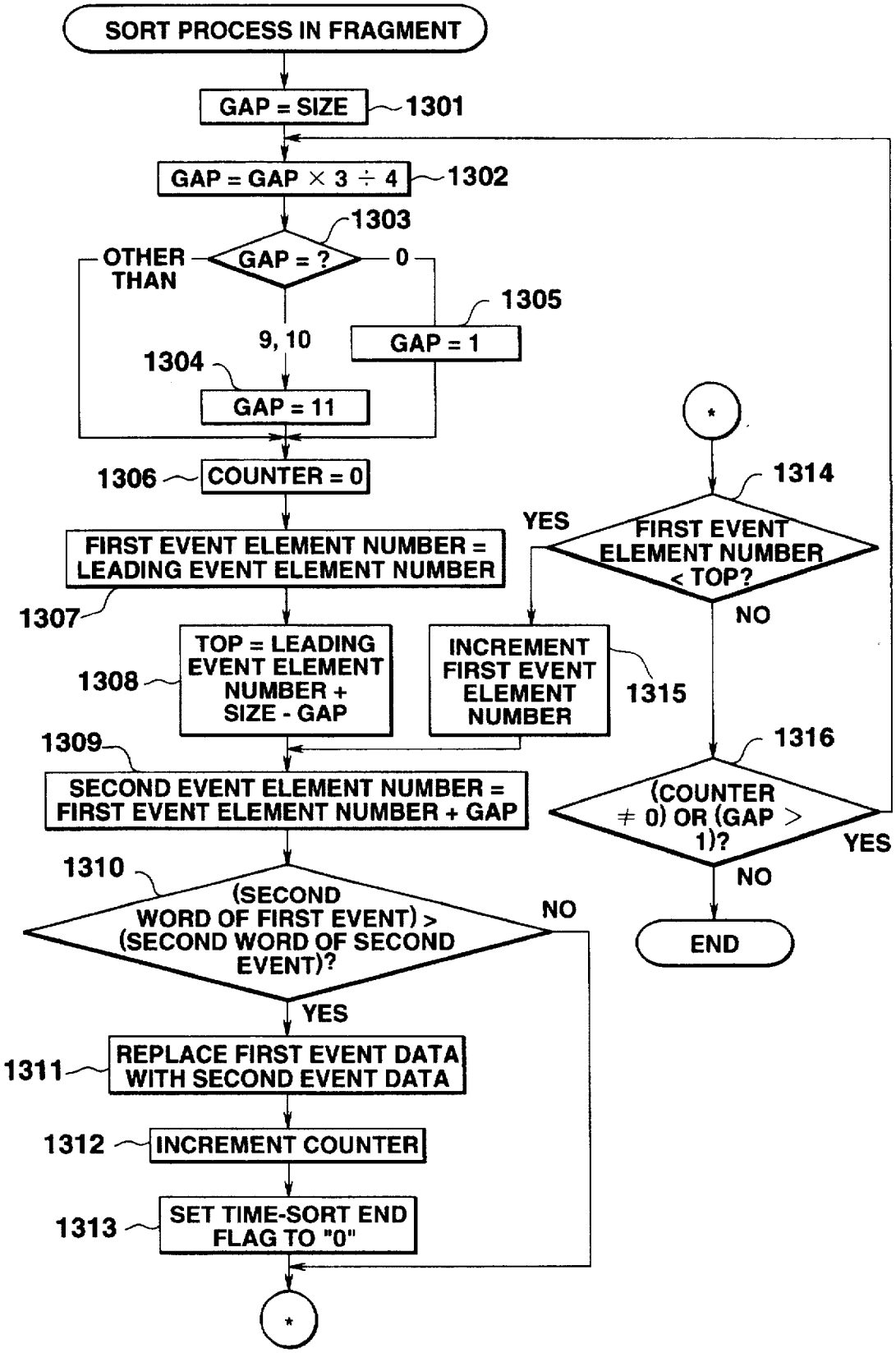
FIG. 13 is a flowchart of a sort process of event data within the event data fragment.

Finally, the time sorting process of step 718 of FIG. 7 for event data within a measure is executed in accordance with the flow chart of FIG. 13. The time sort process of FIG. 13 is for sorting event data with respect to times or clock values of the second words of the respective event data, which event data fall within a range defined by the leading event data the final event data in the event data fragment under processing in the measure stored in the arrangement of SNG-SONG.

Hereafter, a typical sort algorism and a principle of a modified algorism which is employed in the present embodiment will be described briefly. As to the detailed principle of "BUBBLE sort algorism" and "COMSORT algorism", refer to "Simply Modified BUBBLE sort is tremendously fast"

disclosed in the magazine "NIKKEI BYTE", November, 1991 p.305–p.312, published by Nikkei PB.

"BUBBLE sort algorism" is known as a typical sort algorism. To sort data in an ascending order in this algorism, the first event data (second byte) is compared with the second event data to determine which event data is larger. When the first event data is larger than the second event data, then the first and second event data are replaced with each other. Similarly, the new second event data is compared with the third event data, and these event data are replaced with each other, if the former is larger than the latter. In this manner, the above process (comparison and replacement) is repeatedly executed up to the last event data. A unit of the comparison and replacement process to be executed up to the last event data is called a "stroke". Then, the second stroke of process is executed from the first event data up to the last event data, again. Similarly, the stroke of process is repeatedly executed until there is left no event data to be replaced.

In the above BUBBLE sort algorism, since the comparison and replacement process is repeatedly executed on two event data adjacent to each other, the operation is simply executed. But it takes much time if the tail event data in an event data fragment is replaced to near leading position thereof, because the event data to be replaced is replaced only by one address.

The COMSORT algorism has been introduced to overcome inconvenience of the BUBBLE sort algorism. In the COMSORT algorism, two event data adjacent to each other are not compared and replaced with each other as in the BUBBLE sort algorism, but two event data apart more than a distance (hereafter, gap) of one event data are compares and replaced if necessarily.

More specifically, some experiment shows that the following COMSORT algorism is most suitable. For the first stroke of sorting process, the most suitable gap between two event data to be processed will be obtained by dividing a total number of event data to be processed by "1.3". The most suitable gap for the following stroke of sorting process will be obtained by dividing the gap used in the prior sorting process by "1.3", and so on. When the gap reaches 9 or 10 during the sorting processes, the gap is compellingly replaced with "11". When a quotient obtained by dividing the gap by "1.3" is not larger than "1", then the sorting process is repeatedly executed with the gap of "1". When there is left no event data to be replaced in the sorting process with the gap of "1", the sorting process is finished.

The above described COMSORT algorism is known as the fastest algorism. In the COMSORT algorism, a new gap has to be calculated every stroke of process by dividing the prior gap by "1.3", which means that a decimal operation co-processor is necessary, resulting in a larger size of apparatus.

Therefore, the present embodiment employs an algorism in which s "3" and multiplication with a multiplier of "3" and division with divider of "4" are performed in place of the above divisions with the divider of "1.3". In other words, in the present embodiment, division with a divider of "¾" is performed in place of the above division with the divider of "1.3". Therefore, there is no need to use the decimal operation co-processor, which allows the apparatus to be made small in size. Usage of the divider of "¾" does not invite a remarkable increase in time required for such sorting process FIG. 13 is a detailed flow chart of the process to be executed at step 718 based on the above algorism.

In the flow chart of FIG. 13, a number of elements or event data in an event data fragment to be subjected to the sorting process is set to a SIZE (provided in the register of the CPU 103 and the RAM 105). The number of the elements is calculated from an expression of "the tail event data of the fragment–the leading event data of the fragment+1".

The above described gap value is set to a GAP (provided in the register of the CPU 103 or in the RAM 105). Further, an upper limit number of event data is set to a TOP (provided in the register of the CPU 103 or in the RAM 105) in an event-moving loop process, which will be described later.

A moving event counter value to be described later is set to a COUNTER (provided in the register of the CPU 103 or in the RAM 105).

At step 1301, a value of the SIZE is set to the GAP. The value of the GAP is multiplied by "3" and then is divided by "4" at step 1302, as described above. The division is performed actually by shifting by 2 bits in the rightward direction. The calculated quotient is set to the GAP as a new gap value.

It is judged at step 1303 whether the new gap value is "9" or "10". When it is determined that the new gap value is "9" or "10" , i.e., when YES, the value of the GAP is amended to "11" at step 1304 in accordance with the principle of the COMSORT algorism. When the GAP reaches "0", the value of the GAP is amended to "1" at step 1305 in accordance with the principle of the COMSORT algorism. When the value of the GAP is not "9" or "10", the value of the GAP is not amended.

At step 1306, a value of the COUNTER is set to "0". The element number of the leading event data in the event data fragment, which has been obtained in the process of FIG. 7, is set to a first event element number (provided in the register of the CPU 103 or in the RAM 105). The first event element number corresponds to event data which is smaller among two event data to be compared with each other in the event-moving loop process.

Then, a value of TOP is calculated from the following equation:

TOP=the leading event data in the event data fragment+SIZE–GAP.

The value of TOP corresponds to the upper limit value of the first event element number which can be incremented in the event-moving loop process.

Then, the event-moving process is executed at steps 1309–1314, 1315, 1309, where one stroke of comparison and replacement process is performed.

At step 1309, a value of the second event element number (provided in the register of the CPU 103 or in the RAM 105) is calculated from the following equations:

The second event element number=the first event element number+GAP, where the second event element number corresponds to a larger element number among two event data to be compared in the event-moving loop process.

At step 1310, it is judged whether a clock value of the second word of event data corresponding to the first event element number stored in the arrangement of SNG-SONG in the RAM 105 is larger than a clock value of the second word of event data corresponding to the second event element number stored in the arrangement of SNG-SONG in the RAM 105, both clock values which are counted from the leading position of the measure. In other words, it is judged whether event data corresponding to the first event element number should be disposed at a less significant position than a position whether the event data corresponding to the second element number is disposed.

When YES at step 1310, the event data corresponding to the first event element number is substituted for the event data corresponding to the second element number, and vice versa. Thereafter, the COUNTER is incremented at step 1312 and the time-sort end flag is set to "0" at step 1313. Since, when event data is replaced with other event data, the time-sort end flag is set to "0", it is determined YES again at step 602 of FIG. 6 after the sort processes have been executed at steps 604 and 605. Therefore, the time sort process is performed again.

When No at step 1310, the processes at steps 1311 to 1313 are not performed.

At step 1314 of FIG. 13, it is judged whether the first event element number is smaller than a TOP value. When YES at step 1314, the first event element number is incremented at step 1315, and the operation advances to step 1309, where a second event element number is calculated from the first event element number and a GAP. At steps 1310 to 1313, similar processes are repeatedly performed.

The above processes at steps 1309–1315 are repeatedly performed until it will be determined NO at step 1314. In this manner, one stroke of comparison and replacement process event data is performed.

When it is determined NO at step 1314 and one stroke of comparison and replacement process of event data has been fished, the operation goes to step 1315, where it is judged whether a value of the COUNTER is "0", or whether the GAP is larger than "1", i.e., whether event data has been substituted.

When YES at step 1316, a value of the GAP for a new stroke of process is calculated at steps 1302–1305. After steps 1306–1308, the comparison and replacement process of event data is repeatedly executed during the event moving loop process at steps 1309–1315.

When the value of GAP reaches "1" and there is left no event data to be replaced or substituted in the above event moving loop process, and further when NO at step 1316, the sort process for sorting event data within the event data fragment of step 718 is finished.

The embodiment of the present invention has been described in detail but the embodiment is simply illustrative and not restrictive. The present invention may be modified in various manners. All the modifications and applications of the present invention will be within the scope and spirit of the invention, so that the scope of the present invention should be determined only by what is recited in the present appended claims and their equivalents.

What is claimed is:

1. An automatic performance control apparatus comprising:

first memory for storing plural measure data each containing plural event data, each event data including time data counted from a leading position in the measure data;

second memory for storing plural measure-data designating data which designate locations in said first memory where event data contained in the measure data are stored;

a series of measure-data designating data which are continuously stored in said second memory being grouped into plural measure blocks, each measure block containing a group of measure-data designating data;

third memory for storing measure-block designating data which designate locations in said second memory where the groups of measure-data designating data contained in the respective measure blocks are stored; and control means for processing the measure-block designating data stored in said third memory and the measure-data designating data stored in said second memory to control the automatic performance of event data contained in the plural measure data stored is said first memory.

2. An automatic performance control apparatus as claimed in claim 1, wherein:

a series of measure-block designating data which are continuously stored in said third memory are grouped into plural track blocks, each track block containing a group of measure-block designating data and defining a track; and said apparatus, further comprising:

fourth memory for storing track data which determines whether the track defined by said track block is used in the automatic performance;

whereby said control means reads out from said third memory measure-block designating data contained in the track blocks of the track which is determined by the track data stored in said fourth memory to be used in the automatic performance, and processes the read out measure-block designating data and the measure-data designating data stored in said second memory to control the automatic performance of event data contained in the plural measure data stored in said first memory.

3. An automatic performance control apparatus as claimed in claim 1, wherein:

the event data contained the measure data stored in said first memory comprise anyone of note event data and control event data, the note event data including plural informations necessary for generating a musical sound and time data representing a time position counted from the leading position in the measure data, and the control event data including information necessary for controlling reproduction of a music and time data representing a time position counted from the leading position in the measure.

4. An automatic performance control apparatus as claimed in claim 3, wherein:

the note event data includes plural informations necessary for generating a musical sound, such as data representing a frequency and a velocity of the musical sound.

5. An automatic performance control apparatus as claimed in claim 3, wherein:

the control event data comprises anyone of meta event data, jump event data and command event data.

6. An automatic performance control apparatus as claimed in claim 5, wherein:

the meta event data includes information necessary for controlling reproduction of a music, such as data for distinguishing the meta event data from the note event data and data concerning a tempo, beats and a key of the music.

7. An automatic performance control apparatus as claimed in claim 5, wherein:

the jump event data comprises track-end event data inserted to a tail position following to last event data of each track, measure-end event data inserted to a tail position following to last event data in each measure, jump-to event data which, when event data contained in a measure are divided into a first event data block and a second event data block, is inserted to a tail position of the first event data block, and jump-from event data which is inserted to a leading position of the second event data block.

8. An automatic performance control apparatus as claimed in claim 7, wherein:

the track-end event data and the measure-end event data each include a control code for identifying nature of the event codes themselves.

9. An automatic performance control apparatus as claimed in claim 7, wherein:

the jump-to event data includes a control code for identifying nature of the event code itself and an element number to which operation jumps.

10. An automatic performance control apparatus as claimed in claim 7, wherein:

the jump-from event data includes a control code for identifying nature of the event code itself and an element number from which operation jumps.

11. An automatic performance control apparatus as claimed in claim 5, wherein:

the command event data includes data necessary for controlling reproduction of a music, such as data for distinguishing the command event data from the note event data and information for adding a decorative effect on the music.

12. An automatic performance control apparatus as claimed in claim 7, wherein:

event data falling within a range defined by the jump-to event data and the jump-from event data comprises a fragment;

said control means comprises:

first sorting means for sorting the event data contained in the fragment with respect to an attribute of the event data;

second sorting means for sorting jump-to event data and jump-from event data located at connecting positions in the fragments adjacent to each other with respect to the attribute of the event data, after said first sorting means executes the sorting process; and sorting-process control means for controlling said first and second sorting means so as to repeatedly execute the sorting process until no jump event data is left to be replaced.

13. A musical data storing device comprising:

first memory for storing plural measure data each containing plural event data, each event data including time data counted from a leading position in the measure data;

second memory for storing plural measure-data designating data which designate locations in said first memory where event data contained in the measure data are stored;

a series of measure-data designating data which are continously stored in said second memory being grouped into plural measure blocks, each measure block containing a group of measure-data designating data; and third memory for storing measure-block designating data which designate locations in said second memory where the groups of measure-data designating data contained in the respective measure blocks are stored.

14. A musical data storing device as claimed in claim 13, wherein:

a series of measure-block designating data which are continuously stored in said third memory are grouped into plural track blocks, each track block containing a group of measure-block designating data and defining a track; and said device, further comprising:

fourth memory for storing track data which determines whether the track defined by said track block is used in the automatic performance.

15. A musical data storing device as claimed in claim 13, wherein:

the event data contained the measure data stored in said first memory comprise anyone of note event data and control event data, the note event data including plural informations necessary for generating a musical sound and time data representing a time position counted from the leading position in the measure data, and the control event data including information necessary for controlling reproduction of a music and time data representing a time position counted from the leading position in the measure.

16. A musical data storing device as claimed in claim 15, wherein:

the note event data includes plural informations necessary for generating a musical sound such as data representing a frequency and a velocity of the musical sound.

17. A musical data storing device as claimed in claim 15, wherein:

the control event data comprises anyone of meta event data, jump event data and command event data.

18. A musical data storing device as claimed in claim 17, wherein:

the meta event data includes information necessary for controlling reproduction of a music such as data for distinguishing the meta event data from the note event data and data concerning a tempo, beats and a key of the music.

19. A musical data storing device as claimed in claim 17, wherein:

the jump event data comprises track-end event data inserted to a tail position following to last event data of each track, measure-end event data inserted to a tail position following to last event data in each measure, jump-to event data which, when event data contained in a measure are divided into a first event data block and a second event data block, is inserted to a tail position of the first event data block, and jump-from event data which is inserted to a leading position of the second event data block.

20. A musical data storing device as claimed in claim 19, wherein:

the track-end event data and the measure-end event data each include a control code for identifying nature of the event codes themselves.

21. A musical data storing device as claimed in claim 19, wherein:

the jump-to event data includes a control code for identifying nature of the event code itself and an element number to which operation jumps.

22. A musical data storing device as claimed in claim 19, wherein:

the jump-from event data includes a control code for identifying nature of the event code itself and an element number from which operation jumps.

23. A musical data storing device as claimed in claim 17, wherein:

the command event data includes data necessary for controlling reproduction of a music, such as data for distinguishing the command event data from the note event data and information for adding a decorative effect on the music.

* * * * *

UNITED STATES PATENT AND TRADEMARK OFFICE

CERTIFICATE OF CORRECTION

PATENT NO. : 5,672,837

DATED : September 30, 1997

INVENTOR(S) : Masaru SETOGUCHI et al

It is certified that error appears in the above-identified patent and that said Letters Patent is hereby corrected as shown below:

Column 18, line 10, change "is" to --in--.

Signed and Sealed this

Seventeenth Day of February, 1998

*Attest:*

Bruce Lehman

BRUCE LEHMAN

*Attesting Officer*

*Commissioner of Patents and Trademarks*